United States Patent [19]

Nagaura

[11] Patent Number: 4,468,890

[45] Date of Patent: Sep. 4, 1984

[54] APPARATUS FOR THE MANUFACTURE OF LENS-LIKE ARTICLES AND THE LIKE

[76] Inventor: Yoshiaki Nagaura, No. 391-2, Tonoharu, Oaza, Chikushino-shi, Fukuoka-ken, Japan

[21] Appl. No.: 379,320

[22] Filed: May 18, 1982

Related U.S. Application Data

[62] Division of Ser. No. 170,45.

[30] Foreign Application Priority Data

| | | | |
|---|---|---|---|
| Aug. 2, 1979 | [JP] | Japan | 54-99650 |
| Aug. 4, 1979 | [JP] | Japan | 54-99627 |
| Aug. 16, 1979 | [JP] | Japan | 54-105340 |
| Mar. 3, 1980 | [JP] | Japan | 55-27599 |
| Mar. 4, 1980 | [JP] | Japan | 55-27597 |
| Mar. 11, 1980 | [JP] | Japan | 55-32052 |
| May 1, 1980 | [JP] | Japan | 55-59255 |

[51] Int. Cl.[3] ..... B24B 13/02

[52] U.S. Cl. ..... 51/3; 51/105 LG; 51/89

[58] Field of Search ..... 51/3, 105 LG, 106 LG, 51/284 R, 284 E, 277, 235, 237 T, 237 R, 42, 89 R, 118, 81 R, 101 LG; 82/1 C, 11

[56] References Cited

U.S. PATENT DOCUMENTS

| | | | |
|---|---|---|---|
| 11,592 | 3/1897 | Conrader | 51/3 |
| 684,362 | 10/1901 | Flora | 51/3 |
| 2,747,337 | 5/1956 | Geula | 51/101 LG |
| 3,015,196 | 1/1962 | Campbell | 51/277 |
| 3,528,326 | 9/1970 | Kilmer et al. | 51/254 EX |
| 3,810,403 | 5/1974 | Ianuzzi | 51/284 E X |
| 3,978,620 | 9/1976 | Feneberg et al. | 51/105 LG |
| 4,084,458 | 4/1978 | Galley | 51/105 LG |

FOREIGN PATENT DOCUMENTS

| | | | |
|---|---|---|---|
| 2807268 | 8/1979 | Fed. Rep. of Germany | 51/3 |
| 267891 | 2/1928 | United Kingdom | 51/106 |

*Primary Examiner*—Frederick R. Schmidt
*Assistant Examiner*—Robert A. Rose
*Attorney, Agent, or Firm*—McGlew and Tuttle

[57] ABSTRACT

An apparatus for the manufacture of lens-like articles and the like, in which two work holders are provided in a manner to be movable along a common center axis and rotatable thereabout and machining means is provided for surfacing a work or work-piece held by each of the work holders.

A method for the manufacture of lens-like articles and the like in which after machining one surface of the work held by one of the work holders, the work is transferred to the other work holder without changing the center line of machining and subjected to machining of the other surface, thereafter being subjected to edge planing.

Lens-like articles and the like which are obtained by the manufacturing method.

6 Claims, 18 Drawing Figures

Fig.7
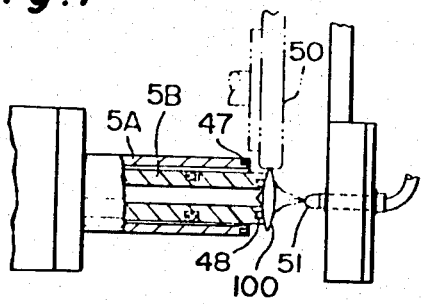
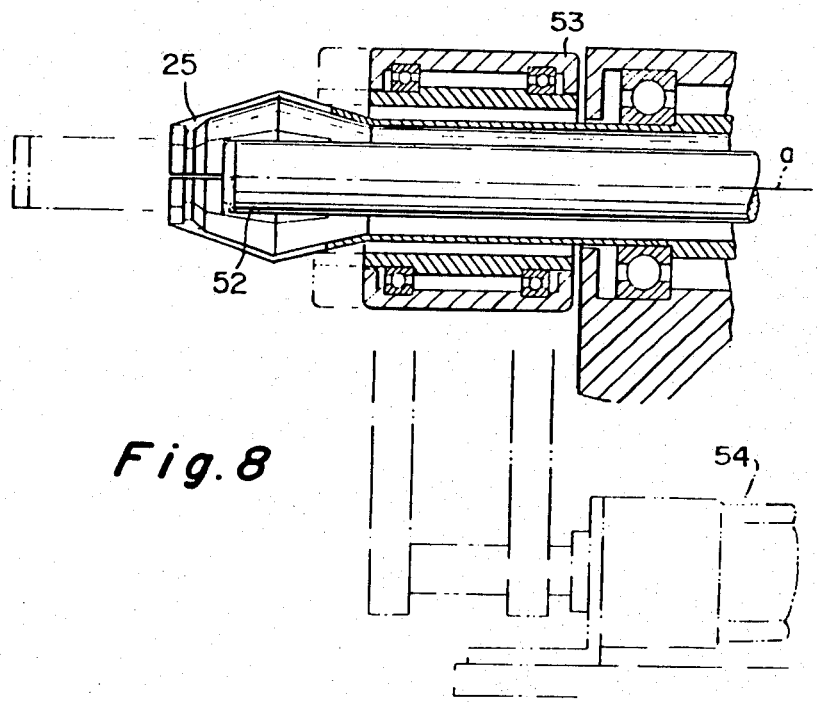
Fig.8

APPARATUS FOR THE MANUFACTURE OF LENS-LIKE ARTICLES AND THE LIKE

This is a division of application Ser. No. 170,450 filed July 21, 1980 now U.S. Pat. No. 4,409,760.

BACKGROUND OF THE INVENTION

1. Field of the Invention

This invention relates to methods and apparatus for the manufacture of lens-like articles and the like which permits fabrication of small-diameter articles and small-diameter lens-like articles and the like which are obtained by the manufacturing apparatus.

2. Description of the Prior Art

In the prior art manufacture of lens-like articles and the like, after machining of one side of a work, it is reversed for machining the other side. In this case, however, the reversal of the work takes time and introduces difficulty in centering for machining of each side of the work. Especially, in the case of a quartz oscillator, since its oscillation frequency and the accuracy thereof are dependent on the size of the oscillator and the accuracy of its configuration, highly accurate machining is required; but such machining has been difficult in the past because no suitable means has been available.

SUMMARY OF THE INVENTION

Accordingly, it is an object of this invention to provide a manufacturing method which enables automatic machining of both sides of a work without changing the center line for machining, which permits fabrication of small-diameter and highly accurate articles.

Another object of this invention is to provide a manufacturing apparatus for putting the abovesaid manufacturing method into practice.

Still another object of this invention is to provide small-diameter, lens-like articles and the like which are obtained by the abovesaid manufacturing method.

These and other objects and advantages of the present invention will become more apparent by referring to the following detailed description and accompanying drawings.

BRIEF DESCRIPTION OF THE DRAWINGS

FIG. 7 shows how the work is subjected to edge planing;

FIG. 8 is a sectional view of another example of the work holder;

DESCRIPTION OF THE PREFERRED EMBODIMENTS

Figure 1:
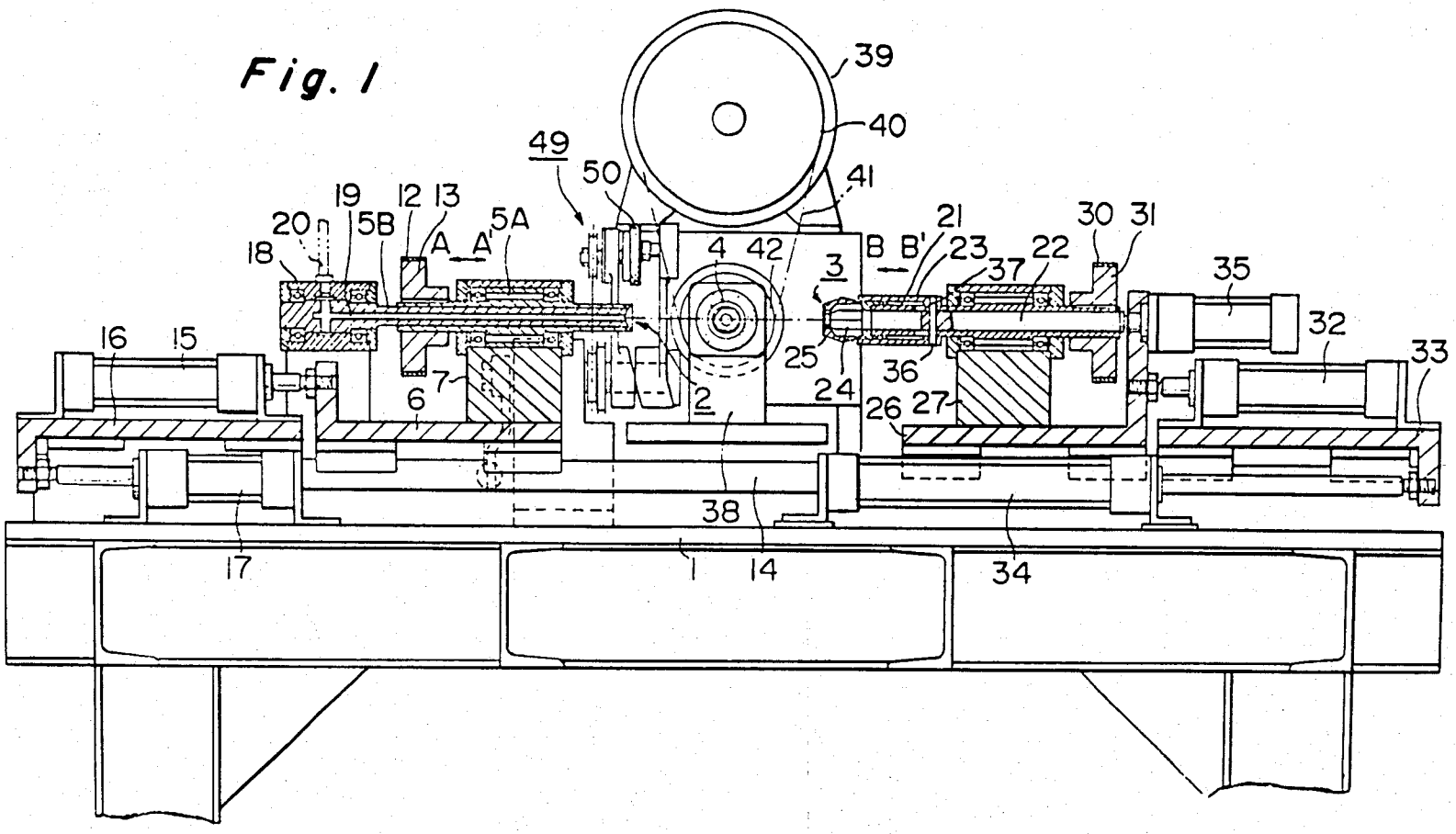
FIG. 1 is a front view illustrating an embodiment of the manufacturing apparatus of the present invention.
Figure 2:
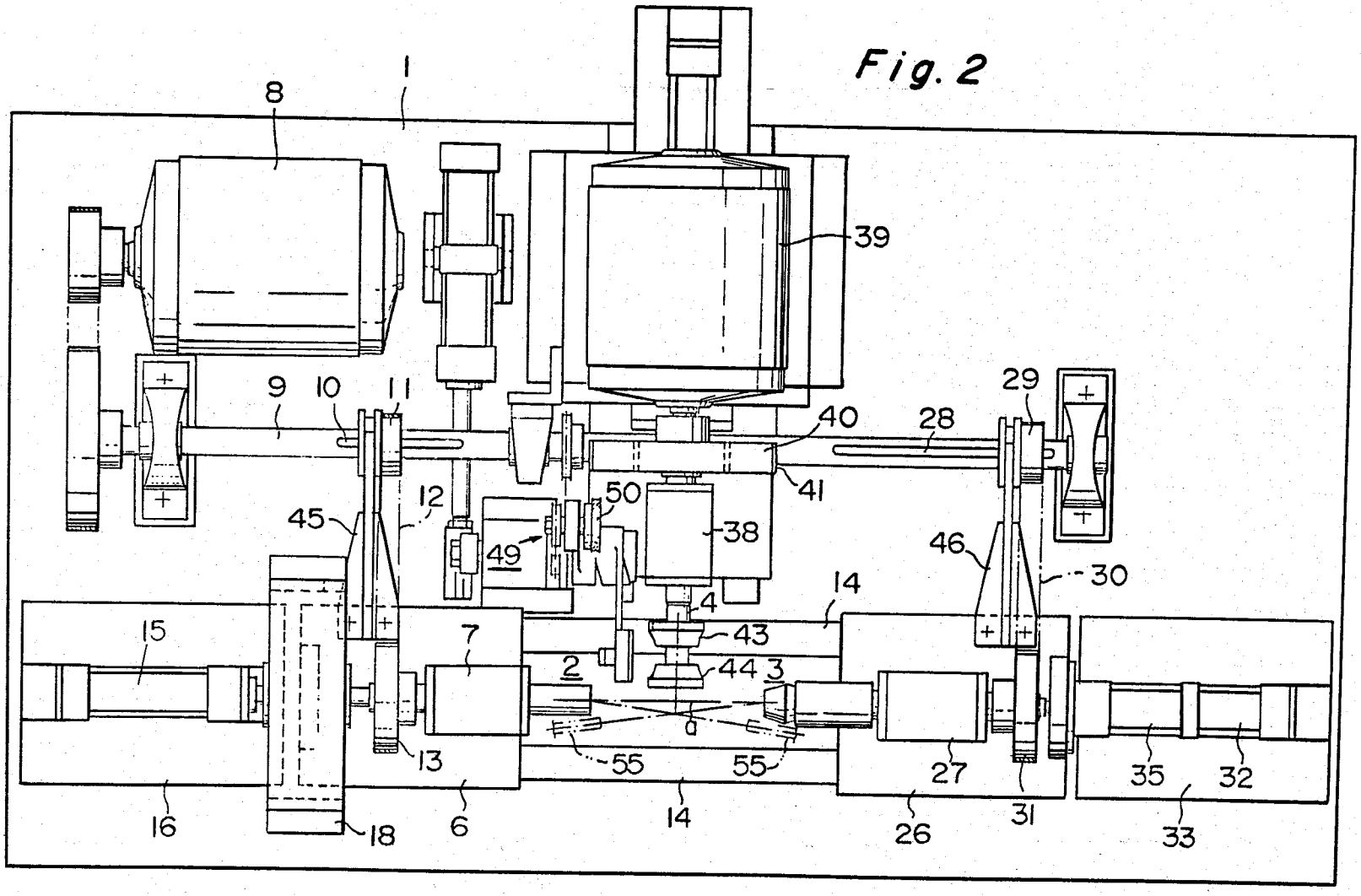
FIG. 2 is its plan view.

FIG. 1 is a front view, partly in section, showing the basic structure of manufacturing apparatus of the present invention and FIG. 2 is its plan view. In FIGS. 1 and 2 reference numeral 1 indicates a chassis; 2 and 3 designate workpiece holders; and 4 identifies a spindle.

The workpiece holder 2 comprises a sliding suction pipe 5A and a horizontal suction pipe 5B. The suction pipe 5A is rotatably supported by a slide table 6 through a support 7 and is driven by a motor 8 through its drive shaft 9, a pulley 11 engaged therewith in a manner to be slidable along a key 10 and through a belt 12 and a pully 13. The slide table 6 is mounted on a horizontal rail 14 on the chassis 1 in a manner to be slidable in the direction indicated by the arrows A and A′ in FIG. 1 and is moved back and forth by a cylinder 15. The cylinder 15 is mounted on a support table 16 which is in turn, mounted on the horizontal rail 14 in a manner to be slidable thereon in the direction A—A′, and the support table 16 is moved back and forth by a cylinder 17 mounted on the chassis 1. The suction pipe 5B is fitted into the suction pipe 5A so that it may move back and forth in the direction A—A′, relative to the pipe 5A, and the suction pipe 5B is rotatably supported at one end by a support member 18 fixed to the chassis 1. The suction pipe 5B has formed therein an air inlet 19, which communicates with a vacuum pump (not shown) through a pipe 20.

The work holder 3 comprises a slide pipe 21, a plunger 22 and a slide tube 23. The slide pipe 21 has formed integrally therewith a chuck 25 which has a plurality of chuck members 24 equally spaced in its circumferential direction. The slide pipe 21 is driven through a pulley 29 mounted on the drive shaft 9 in a manner to be slidable along a key 28 and through a belt 30 and a pulley 31. A slide table 26 is mounted on the horizontal rail 14 in a manner to be slidable therewith in the direction indicated by the arrows B and B′ in FIG. 1 and is moved back and forth by a cylinder 32. The cylinder 32 is mounted on a support table 33 which is mounted on the horizontal rail 14 in a manner to be slidable in the direction A—A′. The support table 33 is moved back and forth by a cylinder 34 secured to the chassis 1. The plunger 22 is fitted into the slide pipe 21 so that it is slidable in the direction B—B′, and is driven back and forth by a cylinder 35 mounted on the slide table 26. The slide tube 23 has slidable fitted thereinto the slide pipe 21 and is coupled by a pin 36 with the plunger 22. The slide pipe 21 has an elongated hole 37 for receiving the pin 36, through which the pin 36 is guided to move the slide pipe 21 together with the plunger 22 when the latter moves back and forth.

The center lines of the workpiece holders 2 and 3 are aligned with each other to form a common or standard center axis line a.

The spindle 4 is rotatably supported by a support member 38 which is provided on the chassis 1 in a manner to be movable in a direction perpendicular to the common center axis line a and is driven by a motor 39 through a pulley 40, a belt 41 and a pulley 42 slidably engaged with the spindle 4. The spindle 4 constitutes surfacing means by an attachment of a cutting plate, grinding plate or the like.

Next, a description will be given of the steps involved in the working of a work.

Figure 3:
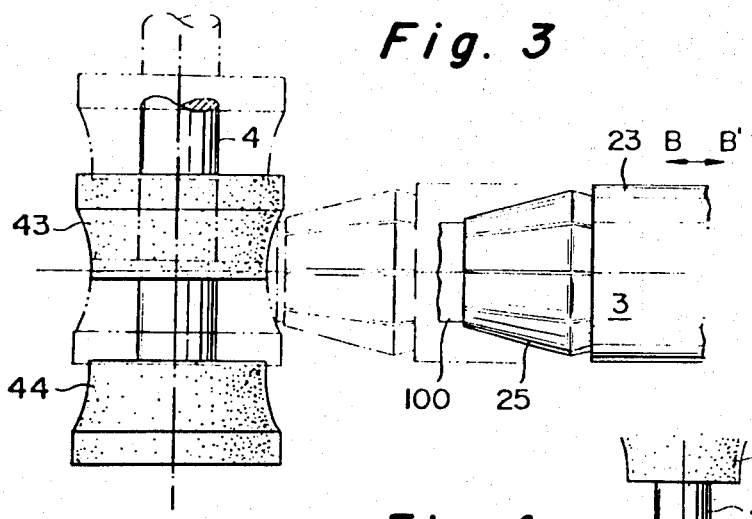
FIG. 3 shows how a work is held by a work holder for machining its one side.
Figure 4:
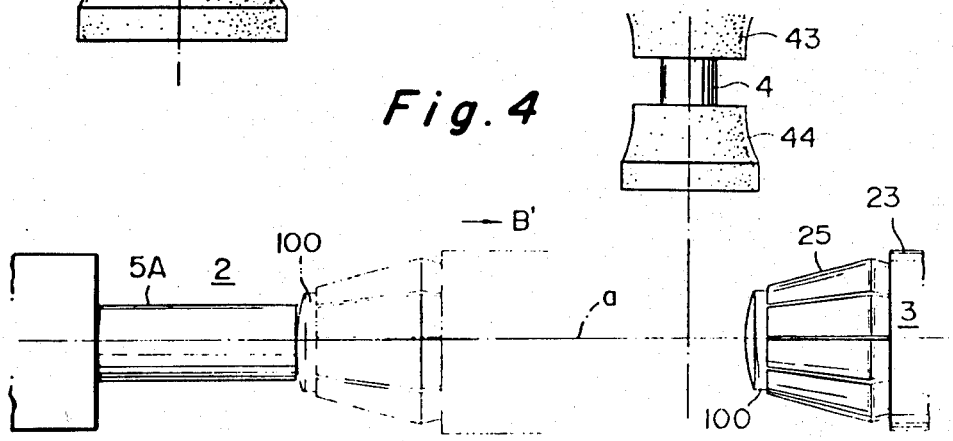
FIGS. 4 and 5 show how the work is transferred to the other work holder for machining the other side of the work.
Figure 5:
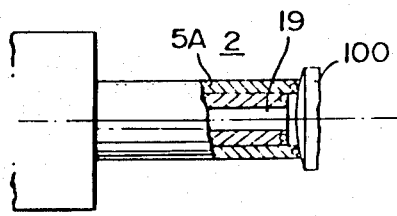
Figure 6:
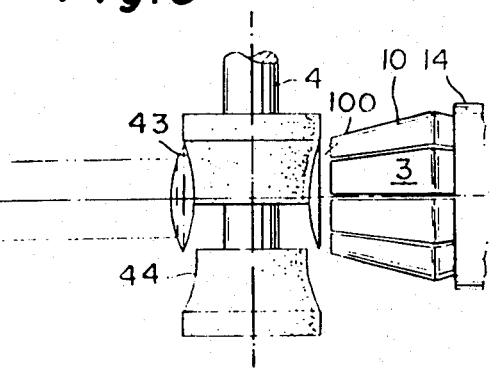
FIG. 6 shows how two works are machined simultaneously.
Figure 9A:
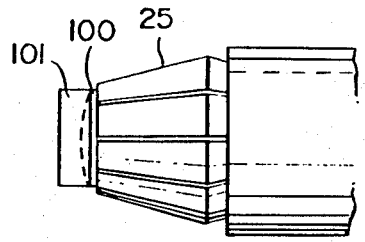
FIGS. 9(*a*) to 9(*d*) show a process of transferring and machining of a work, using a machinable piece.
Figure 9B:
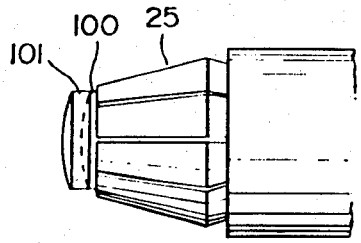
Figure 9C:
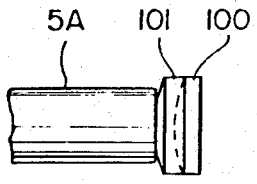
Figure 9D:
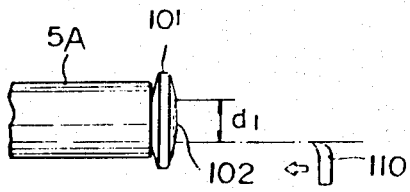

Prior to working, a grinding plate 43 and a polishing plate 44 are attached to the spindle 4, as shown in FIG. 2, and a disc-shaped work 100 of a lens-shaped article or the like is placed into the chuck 25 which is opened and at a position spaced apart from the spindle 4. Moving the slide tube 23 in the direction B by activating the cylinder 35, the slide tube 23 is brought into engagement with the respective chuck members 24 to resiliently deform them, thereby closing the chuck 25 to hold the outer periphery of the work 100. Then, the spindle 4 is moved to bring the grinding plate 43 to the solid-line position in FIG. 3 and is then driven, and the work holder 3 is moved forward, while being driven, to press the work 100 against the grinding plate 43 as indicated by the chain line in FIG. 3, by which one side of the work 100 is ground spherical. The work can be ground into a desired spherical configuration, too, by suitably selecting the shapes of the grinding plate and the polishing plate. This also applies to the working described later on. Then, the spindle 4 is retracted to bring the grinding plate 43 and the polishing plate 44 to the chain-line positions in FIG. 3, where the spherical surface of the work 100 is subject to polish finish by the polishing plate 44. Next, the work holder 3 is moved back in the direction B′ and then stopped, and at the same time, the spindle 4 is also brought back to get out of the opposing relationship to the work holder 3. After this, the work holder 3 is moved forward to the chain-line position in FIG. 4 to urge the worked surface of the work 100 against the suction pipe 5A projecting out of the suction pipe 5B as shown in FIG. 1; then, the work 100 is attracted to the suction pipe 5A by vacuum in the hole 19 communicating with the vacuum pump. In this case, the attractive force is increased by the provision of an O ring on the end face of the suction pipe 5A. After this, the slide tube 23 is moved in the direction B′ to open the chuck members 24 and the work holder 3 is moved back in the direction B′, thus completing transfer of the work to the work holder 2 without changing the center axis of the work, as shown in FIG. 5. Next, the spindle 4 is moved forward to the solid-line position in FIG. 3 and, at the same time, the suction pipe 5A is also moved forward, by the cylinder 15, in the direction A while being rotated; namely, the other side of the work 100 is urged against the grinding plate 43 and then the polishing plate 44 in the same manner as described previously. In this case, it is also possible to hold two works by the work holders 2 and 3 for simultaneous working of them, as depicted in FIG. 6. The reason for which the suction pipe 5A and the slide tube 21 can be rotated although they are moved back and forth is that the pulleys 11 and 29 are respectively engaged with brackets 45 and 46 respectively fixed to the slide tables 6 and 26 which are adapted to be movable. After completion of such working of the both sides of the work 100, the suction pipe 5A is brought back to attract the work 100 to the suction pipe 5B for edge planing, as illustrated in FIG. 7. In FIG. 7, reference numerals 47 and 48 indicate O rings. For the edge planing, an edge grinding machine 49, which is one of the surfacing means, is provided as shown in FIGS. 1 and 2, and a grinding plate 50 of the edge grinding device 49 is engaged with the edge of the work 100 for the edge planing, as shown in FIG. 7. In this case, holding of the work 100 is ensured by applying a pressured fluid from a nozzle 51 to the surface of the work 100, as illustrated in FIG. 7.

In the case where it is necessary to subject the thus worked surfaces of the work 100 to some further treatment, for example, in the case of attaching leads to both sides of a quartz oscillator for measuring its oscillation frequency, the work 100 attracted to the suction pipe 5B is pressed by another holder 52 and is then held in a manner 50 as to be movable in a direction perpendicular to the common center axis a, and then the suction pipe 5B and the holder 52 pressing the work surface are retreated; thus, the work which is now held by a further work holder (not shown) can be subjected to the desired further treatment. FIG. 8 illustrates, by way of example, the holder for pressing the work surface. In this example, holder 52 is provided in the slide tube 21 in a manner to be movable therein, and the holder 52 is moved to its forward position indicated by the chain line to hold the work. In this case, the holder 52 is driven by the cylinder 35 and a slide tube 53 is driven by a different cylinder 54. With the provision of such a holder 52, it is possible to press the work to ensure its holding during the abovesaid edge planing, thereby to provide for enhanced accuracy in the working.

As the means for surfacing the work, it is also possible to employ, in place of the spindle 4, such a curve generator 55 as indicated by the chain lines in FIG. 2.

By dividing the chassis 1 into a fixed chassis and a rotary chassis rotatable about an axis perpendicular to the common center axis, mounting the surfacing means such as the spindle 4, the edge planing device 49 and so forth on the fixed chassis and mounting the work holders and their drive systems on the rotary chassis, it is possible that after working one side of the work held by one work holder and transferring the work to the other work holder, the rotary chassis is truned through 180° to perform working of the other surface of the work.

In the manner described above, surface working of a work can easily be achieved by the apparatus of the present invention with high accuracy. Next, a description will be given of specific examples of working. In the following, no description will be made of the forward and backward movements of the work holders and the surfacing means, but these movements are performed, as required, in the way described above.

A first example is the fabrication of an article having as small a diameter as less than $\frac{1}{8}$ inch. In this case, a disc-shaped work of a size substantially equal to the abovesaid one is held first by the chuck 25 for working one side of the disc into a spherical surface. Next, as shown in FIG. 9(*a*), a machinable piece 101 of a material which has substantially the same machinability as the work 100 is stuck as by an adhesive binder to the worked surface of the work 100. It is desirable that the machinable piece 101 is of the same material as the work 100. Then, the surface of the machinable piece 101 is ground spherical so as to ensure attraction by the suction pipe 5A, as shown in FIG. 9(*b*), and the work 100 is transferred to the suction pipe 5A by attracting thereto the worked surface of the work 100, as shown in FIG. 9(*c*). After the work 100 is thus transferred to the suction pipe 5A, the other side of the work 100 is similarly ground into a spherical configuration, as shown in FIG. 9(*d*). During an early stage of grinding, only the work 100 is ground, but as the working proceeds, The machinable piece 101 is also ground. When the outer diameter of the work 100 has reached a desired value $d_1$, the grinding is stopped and the attraction by the suction pipe 5B is released and then the ground work 102 is disassembled from the machinable piece 101, finishing the grinding operation. In this way, a small-diameter article is obtained by working a large-diameter member which can easily be worked with high accuracy; therefore, the present invention permits easy fabrication of products which is required to be highly accurate. In the case of requiring edge planing, a tool 110 which is separately provided is brought into contact with the edge of the ground work 102 in the direction of the common center axis in the state of FIG. 9(d).

Figure 10:
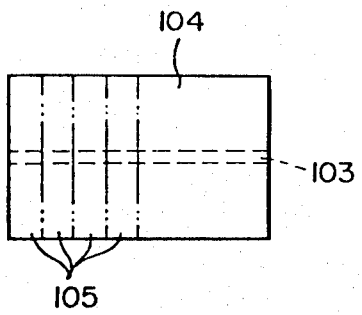
FIG. 10 shows the construction of a work for obtaining small-diameter articles.
Figure 11A:
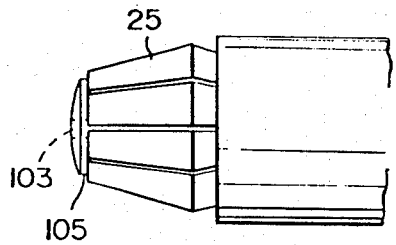
FIGS. 11(*a*) to 11(*d*) show a process of machini ng the work shown in FIG. 10.
Figure 11B:
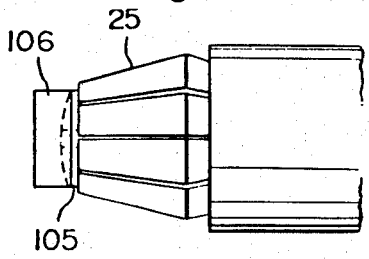
Figure 12:
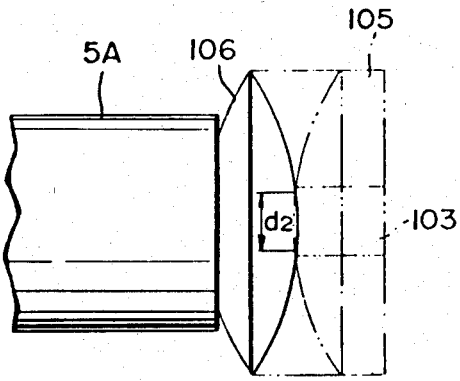
FIG. 12 is an enlarged diagram showing the state of FIG. 11(*d*).
Figure 11C:
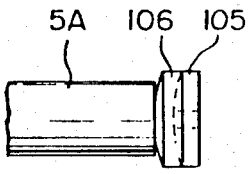
Figure 11D:
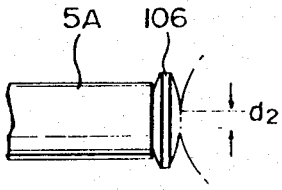

A second example is similarly the fabrication of a small-diameter article. In this case, a work 103 takes the form of a small-diameter bar, which is buried in a machinable member 104 just like the lead of a pencil, as shown in FIG. 10. It is preferred that the machinable member 104 is formed of the same material as the work 103. The work 103 are cut into individual disc-like members 105, as indicated by the chain lines. Each of such disc like members 105 is held by the chuck 25 and ground until one side of the work 103 becomes spherical, as illustrated in FIG. 11(*a*). Then, a machinable piece 106 is assembled as by an adhesive binder with the ground surface of the member 105, as shown in FIG. 11(*b*). Next, the surface of the machinable piece 106 is ground spherical and this spherical surface is attracted by the suction pipe 5A to transfer thereto the work assembly, as shown in FIG. 11(*c*). After this, the other surface of the member 105 is ground until the other side of the work 103 becomes spherical and its diameter reaches a desired value $d_2$. Thereafter, the work assembly is released from the attractive force of the suction pipe 5A and the work thus ground is disassembled from the machinable piece 106, completing the grinding operation. The state in FIG. 11(d) is shown in FIG. 12 on an enlarged scale. Also in this case, the work can be machined into a small-diameter article with high accuracy and, if necessary, edge planing is also possible. Although this example is described in connection with the case where the work is buried in the machinable member, a small piece of work may also be stuck to the machinable member.

It is a matter of course that the methods described above are also applicable to machining of works whose diameters are larger than ⅓ inch.

As has been described in the foregoing, highly accurate lens-like articles can be obtained by the apparatus shown in FIGS. 1 and 2, following the procedure described previously, and in addition, an article of a very small diameter can also be obtained by the procedure described previously in respect of the examples. As the material of the work to be machined, use can be made of glass, quartz and so forth; in particular, by working a quartz material so that its both surfaces are synmmerical, following the procedure described above, a small quartz oscillator with high accuracy can be obtained. Furthermore, the foregoing description has been given of the case of obtaining a spherical surface, but it is a matter of course that the work can be machined into a concave or spherical lens-like configuration such as a flat disc-shaped one or the like.

It will be apparent that many modifications and variations may be effected without departing from the scope of the novel concepts of this invention.

What is claimed is:

1. An apparatus for the manufacture of a lens-like article or the like from a workpiece, comprising:

a pair of opposing workpiece holders, each provided on a chassis in a manner to be movable back and forth along a standard center axis and each rotatable about said center axis;

each of said holders being capable of holding a workpiece independently of the other holder with at least a first one of said workpiece holders being of a suction type for holding a workpiece by suction; and machining means provided on the chassis for machining surfaces of a workpiece held independently in each of said workpiece holders in succession, whereby one surface of a workpiece can be machined while the workpiece is held in a second one of said holders, said holders can be moved together to transfer the workpiece from said second one of said holders to said first one of said holders and the workpiece can be centered on said center axis and held in said first of said workpiece holders by suction.

2. An apparatus for making lens-like articles from workpieces, comprising:

a chassis defining a fixed frame of reference;

a first slide table reciprocally slidable on said chassis in a first linear direction;

a second slide table reciprocally slidable on said chassis in said first linear direction at a location spaced from said first slide table;

first drive means connected to said chassis and engaged with said first slide table for reciprocally sliding said first slide table;

second drive means connected to said chassis and engaged with said second slide table for reciprocally sliding said second slide table;

a first workpiece holder rotatably mounted to said first slide table about a common axis extending parallel to said first linear direction, said first workpiece holder including a suction head for independently holding a workpiece by suction;

suction means connected to said workpiece holder for establishing a suction in said suction head to hold a workpiece;

a second workpiece holder rotatably mounted on said second slide table about said common axis which is parallel to said first linear direction, said second workpiece holder having a holding head for independently holding a workpiece;

lens grinding means connected to said chassis and disposed between said first and second slide tables for grinding a workpiece held by only one of said first and second workpiece holders;

third drive means connected to said chassis and engaged with said first workpiece holder for rotating said first workpiece holder about said common axis;

fourth drive means connected to said chassis and engaged with said second workpiece holder for rotating said second workpiece holder about said common axis;

whereby said second drive means is operable to move said second slide table along said first linear direction with a workpiece in said holding head to bring the workpiece into engagement with said lens grinding means while said fourth drive means rotates said second workpiece holder for effecting grinding of one side of the workpiece, said first drive means being operable to move said first slide table in said first linear direction to bring said suction head into engagement with the workpiece to transfer the workpiece from said holding head to said suction head so that said second drive means can move said second slide table away from said lens grinding means to permit grinding by said lens grinding means of an opposite side of the workpiece being now held by said suction head.

3. An apparatus according to claim 2, including a support member slidably mouted on said chassis in a second linear direction perpendicular to said first linear direction and between said first and second slide tables, said lens grinding means mounted on said support member and including a rotatable spindle with a grinding element thereon, fifth drive means connected to said chassis and engaged with said support member for moving said support member in said second linear direction to bring said grinding element into a position adjacent said common axis for grinding a workpiece held by only one of said first and second workpiece holders.

4. An apparatus according to claim 3, including fixed drive means connected to said support member and engaged with said spindle for rotating said spindle to rotate said grinding element.

5. An apparatus according to claim 2, wherein said first workpiece holder comprises an outer suction pipe mounted to said first slide table and an inner suction pipe rotatably mounted to said first slide table and coaxially disposed within said outer suction pipe, said inner and outer suction pipes being movable with respect to each other along said first linear direction and on said common axis, edge grinding means connected to said chassis on the side of said lens grinding means adjacent said first slide table having a further grinding element adjacent a suction end of said inner suction pipe whereby said outer section pipe can be moved along said first linear direction to expose said end of said inner suction pipe to permit edge grinding of a workpiece held by said inner suction pipe.

6. An apparatus according to claim 5, wherein said holding comprises a holding chuck having clamping fingers for holding a workpiece and means for opening and closing said clamping fingers.

* * * * *